US010024130B2

(12) United States Patent
Ringgenberg

(10) Patent No.: US 10,024,130 B2
(45) Date of Patent: Jul. 17, 2018

(54) DOWNHOLE REPEAT MICRO-ZONAL ISOLATION ASSEMBLY AND METHOD

(71) Applicant: HALLIBURTON ENERGY SERVICES, INC., Houston, TX (US)

(72) Inventor: Paul David Ringgenberg, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 514 days.

(21) Appl. No.: 14/431,214

(22) PCT Filed: Oct. 9, 2012

(86) PCT No.: PCT/US2012/059337
§ 371 (c)(1),
(2) Date: Mar. 25, 2015

(87) PCT Pub. No.: WO2014/058414
PCT Pub. Date: Apr. 17, 2014

(65) Prior Publication Data

US 2015/0226028 A1 Aug. 13, 2015

(51) Int. Cl.
*E21B 43/14* (2006.01)
*E21B 33/124* (2006.01)
(Continued)

(52) U.S. Cl.
CPC ..... *E21B 33/124* (2013.01); *E21B 17/07* (2013.01); *E21B 23/006* (2013.01); *E21B 23/06* (2013.01);
(Continued)

(58) Field of Classification Search
CPC .. E21B 33/124; E21B 33/12955; E21B 23/06; E21B 43/14; E21B 33/1292; E21B 17/07; E21B 23/006
See application file for complete search history.

(56) References Cited

U.S. PATENT DOCUMENTS 3,472,535 A * 10/1969 Kinley ..... E21B 19/10 188/67
3,710,866 A * 1/1973 Pitts ..... E21B 33/1291 166/140
(Continued)

FOREIGN PATENT DOCUMENTS

GB 238427 A 3/2003

OTHER PUBLICATIONS

European Search Report, Supplemental European Search Report, dated Apr. 29, 2016, 7 pages, Europe.
(Continued)

*Primary Examiner* — Waseem Moorad
*Assistant Examiner* — Neel Girish Patel

(57) ABSTRACT

An assembly and method to repeatedly set and isolate multiple sections along a zone of interest in a single downhole trip is disclosed. The assembly includes an outer pipe and an inner pipe adapted to telescope along the outer pipe. After a first section of a zone of interest is isolated, the inner pipe may be telescoped up along the outer pipe, and then set to isolate a second section above the first section. This process may be repeated as desired to stimulate and/or test each desired section along a zone of interest. Once the inner pipe is completely telescoped inside the outer pipe, the inner pipe may be disconnected from the outer pipe via use of a disconnect assembly.

18 Claims, 7 Drawing Sheets

(51) Int. Cl.

| | |
|---|---|
| ***E21B 33/1295*** | (2006.01) |
| ***E21B 23/00*** | (2006.01) |
| ***E21B 17/07*** | (2006.01) |
| ***E21B 23/06*** | (2006.01) |
| ***E21B 33/129*** | (2006.01) |

(52) U.S. Cl.
CPC .... *E21B 33/1292* (2013.01); *E21B 33/12955* (2013.01); *E21B 43/14* (2013.01)

(56) References Cited

U.S. PATENT DOCUMENTS 4,180,132 A * 12/1979 Young ..... E21B 23/006 166/120
4,253,521 A * 3/1981 Savage ..... E21B 33/1294 166/123
4,277,197 A * 7/1981 Bingham ..... B25G 1/04 403/104
4,512,424 A * 4/1985 Heemstra ..... E21B 17/07 166/178
4,516,634 A * 5/1985 Pitts ..... E21B 33/1295 166/120
4,633,944 A * 1/1987 Zunkel ..... E21B 33/1292 166/278
4,791,988 A * 12/1988 Trevillion ..... E21B 33/1294 166/133
4,924,941 A 5/1990 Farley
5,343,949 A * 9/1994 Ross ..... E21B 17/07 166/278
5,413,180 A * 5/1995 Ross ..... E21B 23/06 166/194
5,492,173 A * 2/1996 Kilgore ..... E21B 23/06 166/66.4
5,791,414 A * 8/1998 Skinner ..... E21B 23/006 166/187
5,941,306 A * 8/1999 Quinn ..... E21B 33/1295 166/120
5,954,133 A * 9/1999 Ross ..... E21B 17/07 166/297
6,481,503 B2 11/2002 Hamilton et al.
7,051,812 B2 5/2006 McKee et al.
7,681,654 B1 * 3/2010 Cugnet ..... E21B 33/124 166/177.5
2002/0195248 A1 12/2002 Ingram et al.
2008/0053652 A1 3/2008 Corre et al.
2010/0218935 A1 * 9/2010 Matherne, Jr. ..... E21B 19/06 166/77.51

OTHER PUBLICATIONS

International Search Report and Written Opinion of the ISA/US prepared for PCT/US2012/059337, dated Mar. 13, 2013, 17 pages.

* cited by examiner

DOWNHOLE REPEAT MICRO-ZONAL ISOLATION ASSEMBLY AND METHOD

FIELD OF THE INVENTION

The present invention relates generally to downhole testing or stimulation operations and, more specifically, to an assembly and method for repeated setting and isolation of multiple sections along a zone of interest.

BACKGROUND

In conventional downhole stimulation or testing procedures, the stimulation or testing assembly is deployed downhole into the desired zone of interest, which may be thousands of feet long. Thereafter, the entire zone is stimulated or tested at once to determine if it will produce or to conduct pressure testing.

Such an approach is problematic in that it is very difficult to determine which portions of the zone of interest are producing or resulting in pressure changes. Although flow and pressure data are generated for the zone, it is difficult to determine if such is measurements arise from the toe, heel, or somewhere in-between along the zone of interest.

In view of the foregoing, there is a need in the art for an assembly which allows isolation and stimulation and/or testing of desired sections along a zone of interest of a well.

DESCRIPTION OF ILLUSTRATIVE EMBODIMENTS

Illustrative embodiments and related methodologies of the present invention are described below as they might be employed in a downhole assembly and method for repeated setting and isolation of multiple sections along a zone of interest. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1A:
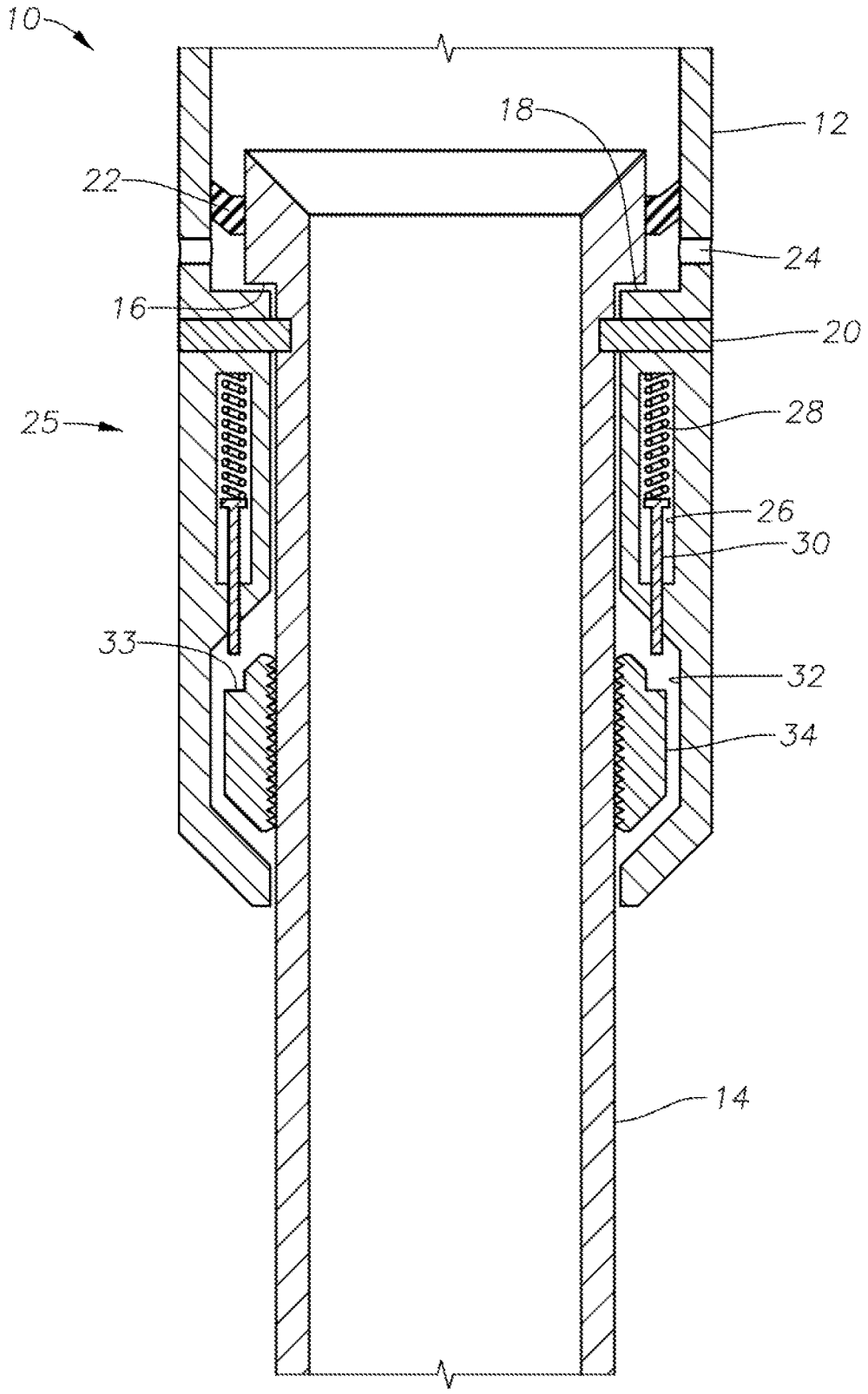
FIGS. 1A-1C illustrate cross-sectional views of a micro-zonal isolation assembly according to an exemplary embodiment of the present invention.
Figure 1B:
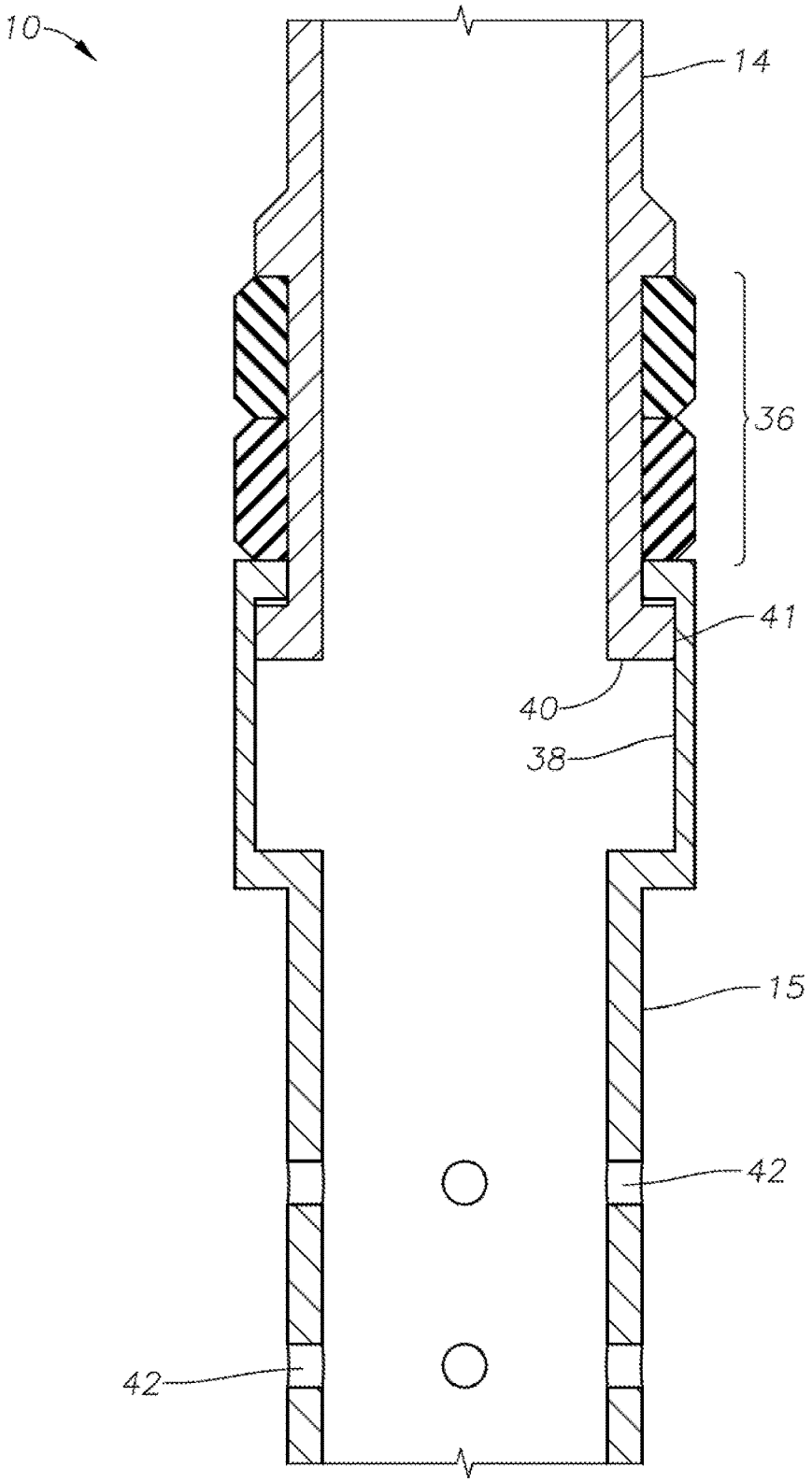
Figure 1C:
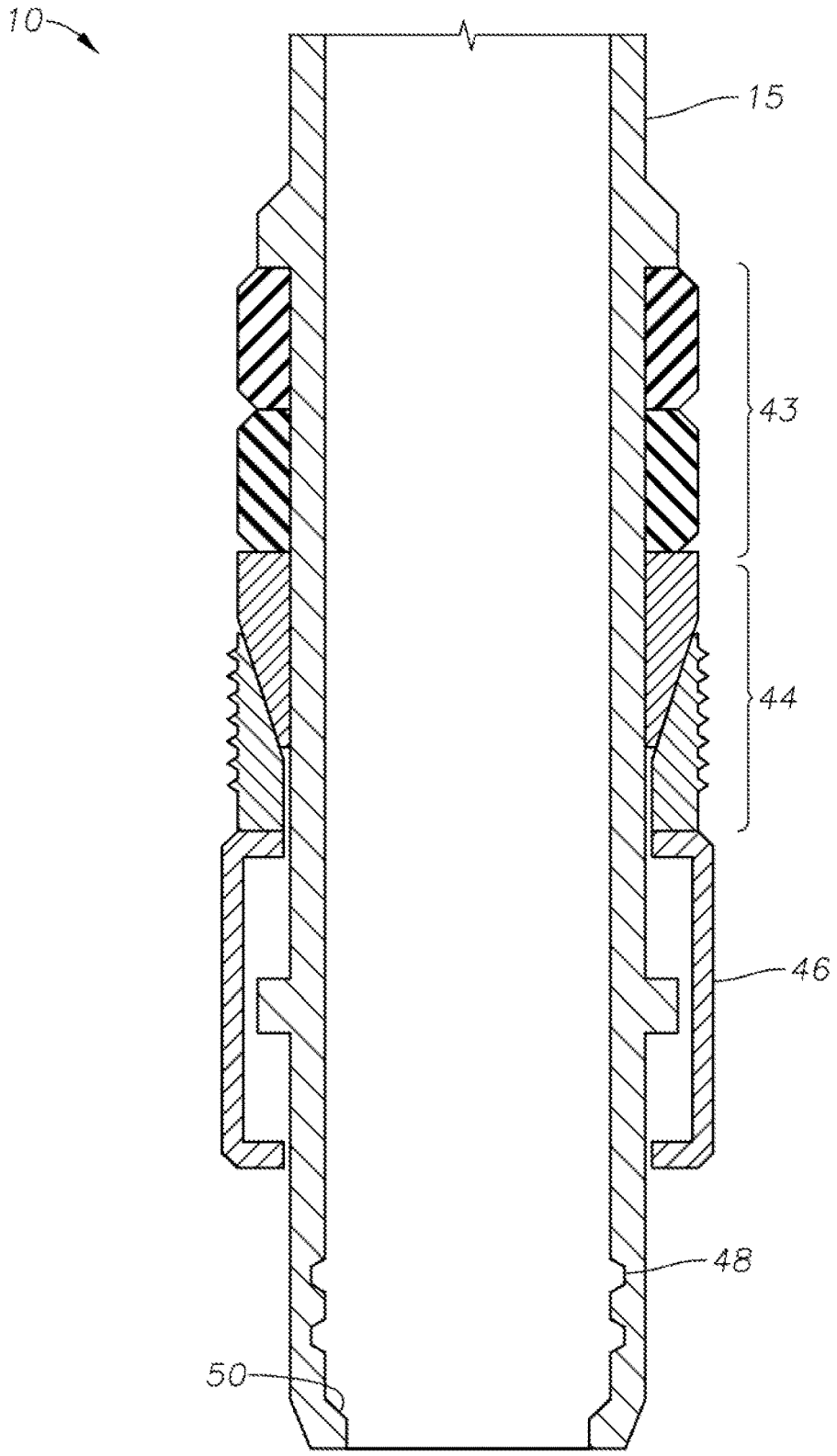

FIGS. 1A-1C are cross-sectional views of a micro-zonal isolation assembly 10 according to exemplary embodiments of the present invention. A downhole string, including a tubular or pipe 12, extends downhole to a zone of interest. The downhole string may comprise a variety of components in addition to those described herein, as would be understood by those ordinarily skilled in the art having the benefit of this disclosure. An inner tubular or pipe 14 such as, for example, a flush joint pipe, is connected to the bottom of pipe 12, with a packer section 15 attached to the lower end of inner pipe 14, as shown. In alternative exemplary embodiments, an external or internal upset pipe or a collared pipe may be utilized as the inner pipe as well. Those ordinarily skilled in the art having the benefit of this disclosure realize there are a variety of pipes or tubulars that may be utilized as the inner pipe.

As will be described herein, inner pipe 14 is adapted to telescope up inside pipe 12, thus allowing inner pipe 14 to be moved to progressively higher sections of a zone of interest (i.e., further away from the bottom of the hole). As such, exemplary embodiments of the present invention allow for repeated setting and isolation of multiple small sections of the zone of interest. Once isolated, that section of the zone of interest may undergo a variety of operations. For example, the isolated section may be allowed to flow and be shut in for pressure transient analysis; injection may be established for an injection/fall-off analysis; or fracturing treatments may be performed.

Persons ordinarily skilled in the art will understand that inner pipe 14 is not drawn to scale, as it may be as long as desired (e.g., 2000 ft. or more), but is rather illustrated as such for simplicity. Moreover, in exemplary embodiments of the present invention, inner pipe 14 may be selected to be at least the length of the zone of interest. As such, any section of the zone of interest may be isolated, and operations performed thereon as desired, in a single downhole trip.

During initial deployment, micro-zonal isolation assembly 10 is coupled at the lower end of pipe 12. As shown, inner pipe 14 extends up into the lower end of pipe 12. A shoulder 16 extends from inner pipe 14, where it rests atop a mating shoulder 18 of pipe 12. A shear pin 20 also extends between inner pipe 14 and pipe 12 in order to assist in retaining inner pipe 14 during deployment and subsequent setting and isolation operations, as will be described.

One or more flexible seals 22 may be disposed between the top of inner pipe 14 and the inner diameter of pipe 12 and seal there between. Since seal 22 is flexible, it is disposed to pass any internal upsets along the upper pipe string that may be encountered. Seal 22 is desirable to isolate the pressure inside inner pipe 14 from the pressure outside pipe 12. In one exemplary embodiment in which stimulation is conducted, seal 22 is is connected to inner pipe 14, thus moving up as inner pipe 14 moves up. In another embodiment, seal 22 may be connected to the inner diameter of pipe 12, thus remaining stationary and sealing to the outer diameter of inner pipe 14 as it moves up. Nevertheless, one seal position may be utilized for both stimulation and testing. Also, a pressure port 24 may be positioned along pipe 12 underneath seal 22 in order to allow the annulus between inner pipe 14 and pipe 12 fill with fluid during telescoping.

Further referring to the exemplary embodiment of FIGS. 1A-1C, a telescoping locking assembly 25 is positioned along pipe 12 below shoulder 18. Telescoping locking assembly 25 includes a chamber 26 having a spring 28 disposed therein. A telescoping latch 30 is coupled to spring 28 and extends out beneath chamber 26. Although not shown, telescoping latch 30 is connected to a continuous telescoping "J-slot" positioned along the inner surface of chamber 26. As described herein, the J-slot works in conjunction with telescoping latch 30 to achieve telescoping. Adjacent chamber 26 is profiled area 32 in which a wedge 34 is positioned. In certain embodiments, wedge 34 comprises a teethed inner diameter and is disposed to grip inner pipe 14, and a profiled outer diameter which mates, and works in conjunction, with profiled area 32 of pipe 12. A latch engagement portion 33 is formed at the upper end of wedge 34 and provides a surface for telescoping latch 30 to engage wedge 34 to inhibit wedge 34 from gripping inner pipe 14.

As described below, telescoping locking assembly 25 allows inner pipe 14 to telescope up into pipe 12 in order to facilitate the micro-zonal operations of the present invention. Specifically, in one exemplary embodiment, the J-slot allows telescoping latch 30 to retract upward every other time wedge 34 presses up against it. Thus, wedge 34 is disposed to engage the angled surfaces of profiled area 32 and grip inner pipe 14 every other time pipe 12 is lowered.

A packer 36, such as a upper compression set packer, is positioned along packer section 15 inner pipe 14. In this embodiment, a compression profile 38 is formed along the inner diameter of the upper portion of packer section 15 below upper packer 36. Compression profile 38 permits the portion 40 of inner pipe 14 to slidingly move downwards, thereby compressing upper packer 36 outwardly to seal against the wellbore wall or casing, as would be understood by persons ordinarily skilled in the art having the benefit of this disclosure. Rotational lugs 41 may be provided, such as at the end 40 of pipe 14 to transmit setting torque down to drag block assembly 46, as will be described.

Zone ports 42 are positioned along packer section 15 below compression profile 38 in order to facilitate the micro-zonal operations of the present invention. Although two ports 42 are illustrated, more or less may be provided. A lower compression packer 43 is positioned along packer section 15 below zone ports 42. A slip assembly 44 is positioned along packer section 15 below lower packer 43 and works in conjunction with drag block assembly 46 and downward movement of inner pipe 14 in order to seal lower packer 43 against the casing or open hole wall, as would be understood by ordinarily skilled persons having the benefit of this disclosure. Accordingly, upper packer 36 and lower packer 43 serve to isolate the desired section of the zone of interest. Persons ordinarily skilled in the art having the benefit of this disclosure will understand that the exemplary embodiments are not limited to a particular type of packer.

Still referring to the exemplary embodiment of FIGS. 1A-1C, a drag block assembly 46 is positioned along the lower end of packer section 15 below slip assembly 44. Drag block assembly 46 permits the packers to be set and provides the initial force necessary for slip assembly 44 to extend out and engage the casing or perforated liner in cased hole operations. Beneath drag block assembly 46 a profile 48 may be formed in packer 15 for receipt of a slick line plug (not shown). In addition to, or in the alternative, at the bottom of packer section 15, along its inner diameter a shoulder 50 may be formed and disposed to seat a pump down ball or plug to facilitate zonal operations as described herein.

Figure 1D:
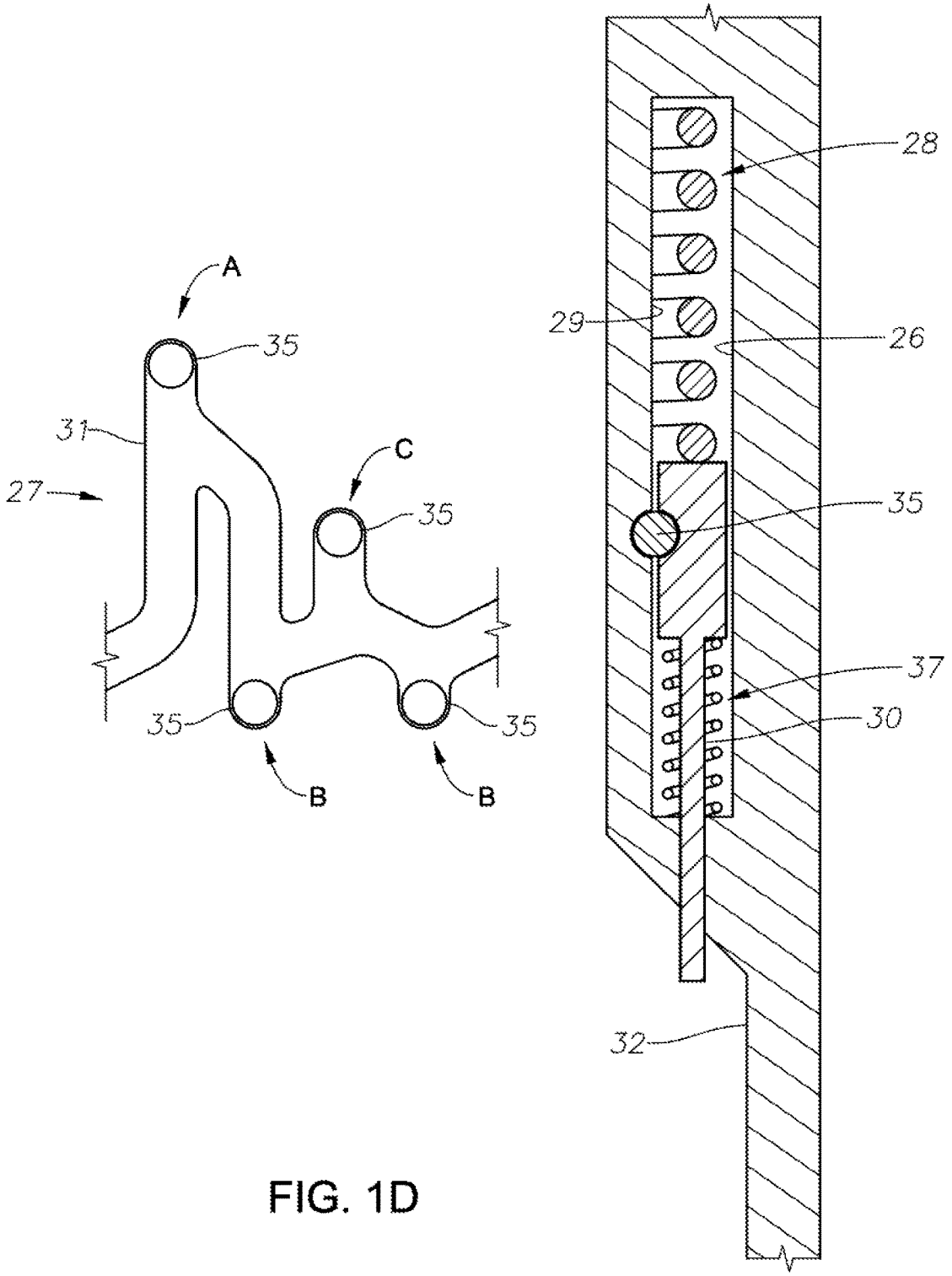
FIG. 1D illustrates a continuous J-slot utilized in a telescoping locking assembly according to an exemplary embodiment of the present invention.
Figure 2A:
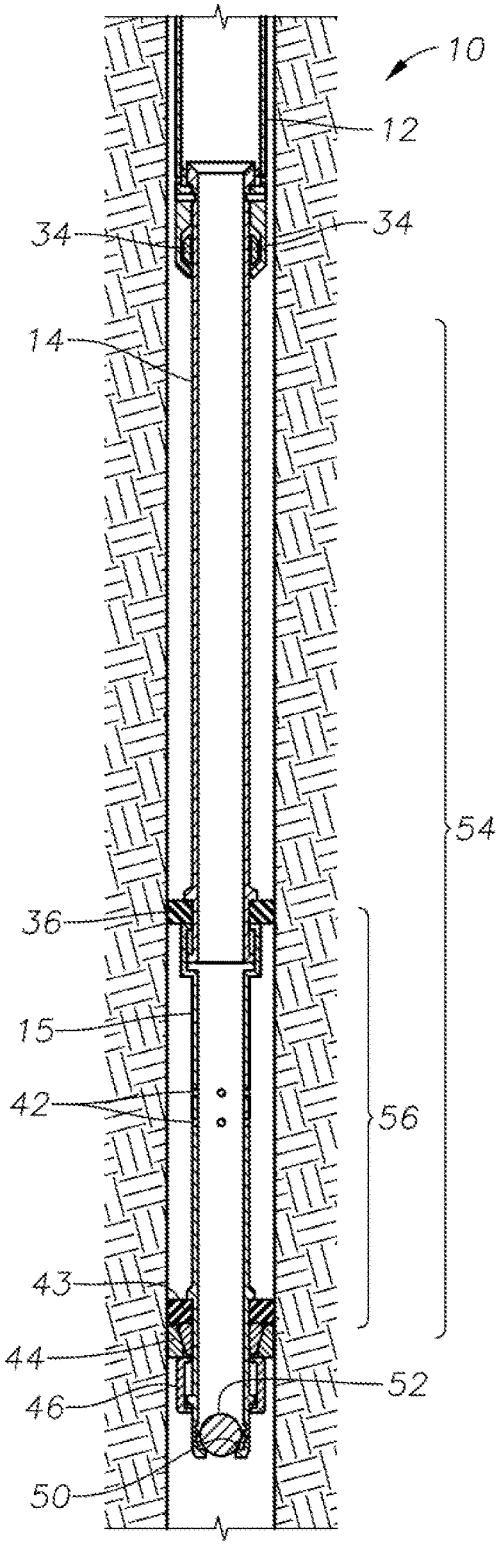
FIGS. 2A & 2B illustrate cross-sectional views of a micro-zonal isolation assembly during various stages of a downhole stimulation and/or testing operation, according to an exemplary methodology of the present invention.
Figure 2B:
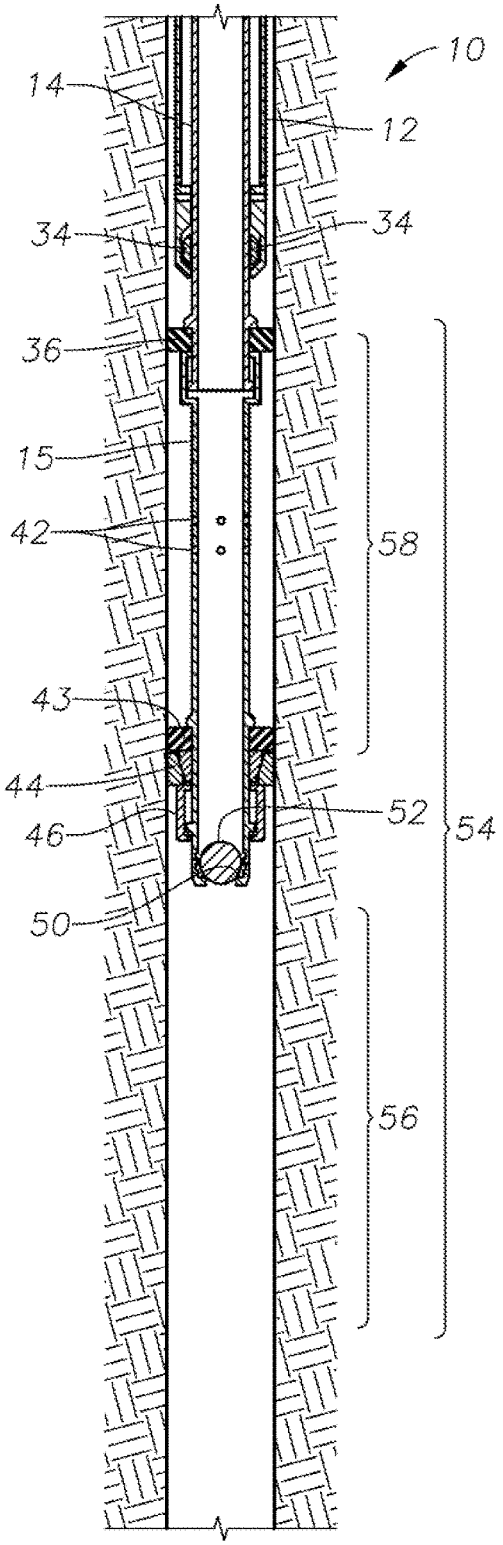

FIGS. 2A & 2B illustrate micro-zonal isolation assembly 10 in a first and second isolation position, respectively, along a zone of interest, according to exemplary embodiments of the present invention. In reference to FIGS. 1A-2B, an exemplary operation utilizing micro-zonal isolation assembly 10 will now be described. To begin the operation, inner pipe 14 and packer section 15 are inside pipe 12 so that shoulders 16,18 abut. Then, micro-zonal isolation assembly 10 is lowered into the well until it is positioned adjacent the bottom of a zone of interest 54. As previously described, it is desirable that inner pipe 14 is at least the length of zone of interest 54. However, other lengths may be utilized as desired.

In this exemplary methodology, a treatment operation is described. However, as previously mentioned, an injection or pressure operation, for example, may be conducted as may other operations. Nevertheless, a ball 52, which has been pumped down the string through pipe 12 and inner pipe 14, is seated atop shoulder 50, as shown in FIGS. 2A and 2B. In the alternative, a pump down cushion may be utilized if conducting a drill stem test, as would be understood by those ordinarily skilled in the art having the benefit of this disclosure.

Once ball 52 is seated, slip assembly 44 is set. In certain exemplary embodiments deployed in cased holes, in order to set slip assembly 14, the downhole string, and thus micro-zonal isolation assembly 10, may be picked or pulled up, turned, and sat down, thereby setting slip assembly 44. However, this setting process is given by way of example only, as those ordinarily skilled in the art having the benefit of this disclosure realize there are a variety of ways in which to set the slip assembly. For example, in open hole applications, a side wall anchor could be utilized to set the packers. Nevertheless, from this point on in the operation of micro-zonal isolation assembly 10, slip assembly 44 will engage the open hole wall (or casing in cased holes) each time inner pipe 14 is lowered. Slip assembly 44 may also be designed such that a counter rotation procedure, for example, would deactivate this feature, as would also be recognized by those same ordinarily skilled persons.

Further referring to FIG. 2A, once slip assembly 44 is set, upper packer 36 and lower packer 43 may be activated. In one embodiment, weight is sat applied to upper packer 36 and lower packer 43, thereby settings the packers and isolating a first isolated section 56 of zone of interest 54. In an alternative exemplary embodiment, more than two packer elements could be utilized along packer section 15 so that pressure differentials would be spread out over a greater area. Treatment fluid is pumped down the string, through pipe 12 and inner pipe 14, out through zone ports 42, and into the formation along first isolated section 56. If a drill stem test is being conducted, injection or bleed off may be initiated.

Nevertheless, once the desired downhole operation is complete, the string 12 is picked up or moved up-hole a desired distance (such as, for example, a distance equal to the distance between upper and lower packers 36,43), and the string is then lowered back down or moved down-hole. When the string is picked up, micro-zonal isolation system 10 also moves up. As such, micro-zonal isolation assembly 10 is now positioned adjacent the next section of the zone of interest up-hole of the previous section 56. As previously described, each time inner pipe 14 is lowered (after the initial setting), slip assembly 44 will engage the wellbore wall. Thus, upon the first lowering, slip assembly 44 is set, and shear pins 20 between inner pipe 14 and pipe 12 are sheared. As a result, inner pipe 14 will telescope up into pipe 12 during the remainder of the procedure.

Referring to FIG. 2B, once micro-zonal isolation assembly 10 is adjacent the second isolated section 58 along zone of interest 54, upper and lower packers 36,43 are set again. First, the string is picked up and then sat back down, thus transferring weight from pipe 12 to inner pipe 14. In order to accomplish this, as previously described, in certain embodiments telescoping locking assembly 25 is equipped with a continuous automatic indexing J-slot (FIG. 1D) along the inner surface of chamber 26, which is connected to latch 30. Every other time the pipe 12 moves down relative to inner pipe 14, the automatic indexing J-slot allows latch 30 to move upward via compression of spring 28. Wedge 34 then is allowed to move up profiled area 32, seat against the upper angular surface of profiled area 32, grip inner pipe 14 to stop the travel (or telescoping) of inner pipe 14 up inside pipe 12, thus forcing weight down on inner pipe 12 and causing packers 36,43 to set. Accordingly, micro-zonal isolation assembly 10 is now secured in positioned to treat or test second isolation section 58 of zone of interest 54.

Thereafter, when it is desired to move micro-zonal isolation assembly 10 to other sections of interest, pipe 12 is picked up again. As a result, spring 28 urges telescoping latch 30 downward and into contact with latch engagement portion 33, thus forcing wedge 34 downward. As pipe 12 continues to be picked upwardly, wedge 34 contacts the lower angular surface of profiled area 32 which causes wedge 34 to grip inner pipe 14, thus picking inner pipe 14 up as well until micro-isolation assembly 10 is positioned adjacent the next section to be isolated. Once micro-isolation assembly 10 is positioned there, the string is sat down again which, as previously described, causes inner pipe 14 to set. At the same time, however, wedge 34 attempts to move upward along chamber 32 until prevented from further movement by telescoping latch 30. Here, the J-slot, as previously described, only allows compression of latch 30 in chamber 26 every other time pipe 12 moves downwardly. In such cases, latch 30 and wedge 34 are held in place by the J-slot, thus allowing inner pipe 12 to telescope up inside pipe 12.

Once inner pipe 14 is telescoped a sufficient amount in pipe 12, pipe 12 is picked up and sat back down. In turn, the J-slot then permits latch 30 to compress spring 28, thus allowing wedge 34 to move upward along profiled area 32 until the upper portion of profiled area 32 urges wedge 34 to grip inner pipe 14 again. Downward weight, or some other activation mechanism, can then be applied to set packers 36,43, after which the isolation section may now be treated or tested as previously described.

Accordingly, the J-slot allows telescoping latch 30 to act in like manner to a ball-point pin. For example, every other time it is actuated, latch 30 will extend downwardly to force wedge 34 down and allow inner pipe 14 to telescope. Every other time latch 30 remains recessed along chamber 26, wedge 34 is allowed to wedge against inner pipe 14, thus preventing telescoping of inner pipe 14. FIG. 1D illustrates an exemplary embodiment of the continuous J-slot 27 positioned along the inner surface 29 of chamber 26. J-slot 27 comprises a cam path 31 in which a ball 35, connected to latch 30, follows during telescoping operations. Also, a spring 37 is positioned below latch 30 along chamber 26 as shown to provide an opposing force to spring 28. In this embodiment, spring 28 would have a higher spring constant than spring 37. As shown, ball 35 is located at position A, which is the "set weight on packer" position wherein wedge 34 engages inner pipe 14. Position B is the "string in tension" position and position C is the "de-telescoping" position in which wedge 34 slides along inner pipe 14. FIG. 1D is provided as one of many examples, as those ordinarily skilled in the art having the benefit of this disclosure will realize there are a variety of other ways in which to design a J-slot to achieve this, or another, functionality.

Although the foregoing has been described in relation to two isolated sections along the zone of interest, the present invention is not to be so limited, as the foregoing exemplary methodology can be repeated multiple times as inner pipe 14 is progressively telescoped up into pipe 12. As such, if further sections were present, micro-zonal isolation assembly 10 would continue to be telescoped up through the entire zone of interest. Moreover, in exemplary embodiments of the present invention, the spacing between the packers along inner pipe 14 may be chosen to be roughly the same length as the height that the surface head could be raised without requiring any pressure lines to be disconnected (e.g., 30-40 ft.), as would be understood by those ordinarily skilled in the art having the benefit of this disclosure. Accordingly, the flow head does not have to be removed, thus saving valuable time.

Once the length of zone of interest 54 is tested or stimulated, the string, including micro-zonal isolation assembly 10, may be retrieved from the well. To allow for simple and efficient removal of the now telescoped inner pipe 14 from pipe 12, the present invention provides a number of alternative exemplary embodiments and methodologies. In a first methodology, a chemical cutter may be used to cut inner pipe 14 above wedge 34.

Figure 3A:
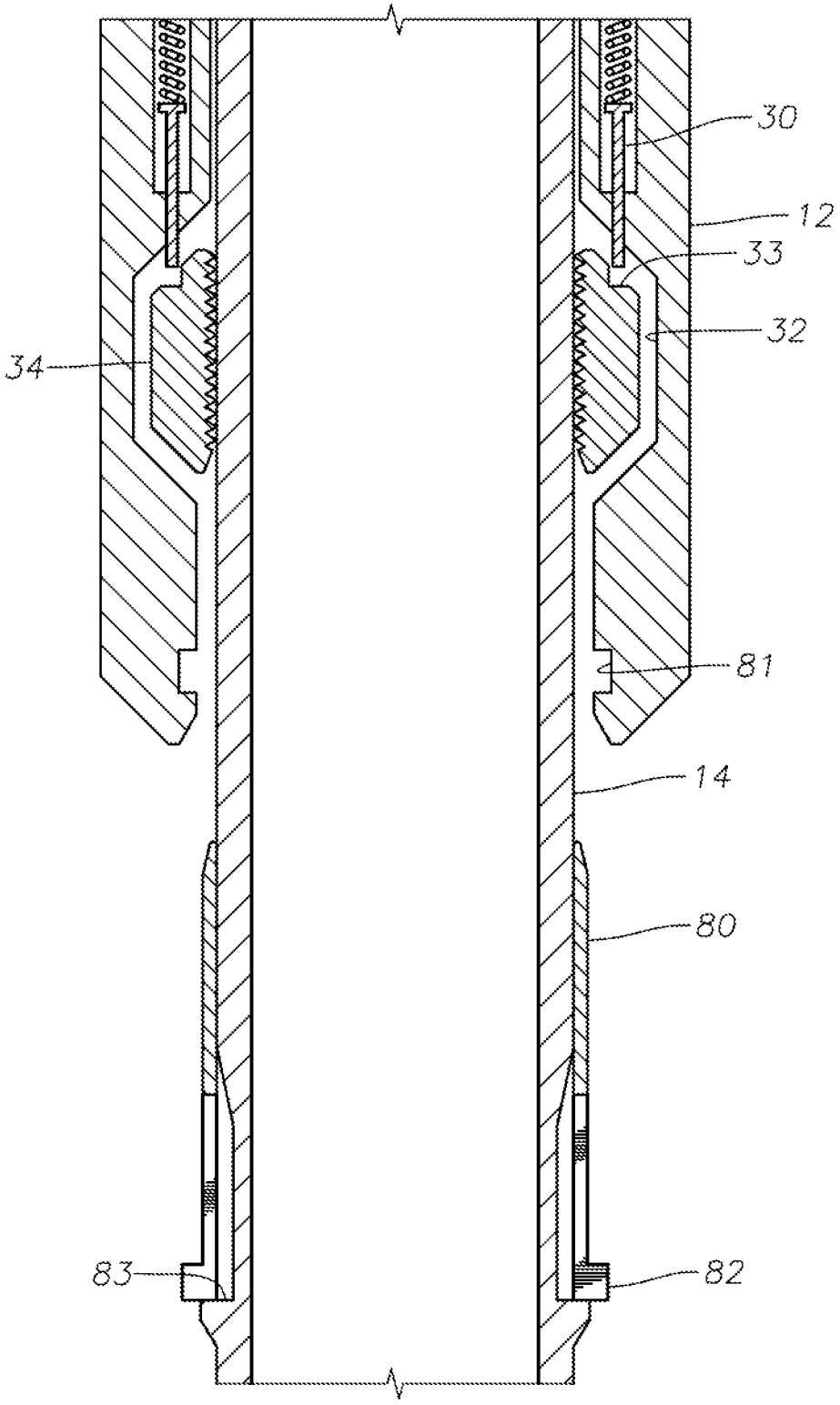
FIGS. 3A & 3B illustrate cross-sectional views of various disconnection assemblies according to exemplary embodiments of the present invention.

In a second exemplary embodiment shown in FIG. 3A, a sleeve 80 is positioned above upper packer 36, sleeve 80 may be forced under wedge 34, thus deactivating wedge 34 and allowing inner pipe 14 to slide back up and out of pipe 12. As shown, a collet latch 81 is formed along the lower end of pipe 12 below profiled area 32. Sleeve 80 is positioned around inner pipe 14 above upper packer 36. A flexible collet 82 forms part of sleeve 80. A spring (not shown) may also be positioned at spring collet 82 to bias collet 82 outward. Sleeve 80 is desirably free floating; however, the free floating travel is limited by profile 83 on inner pipe 14. As such, once inner pipe 14 is telescoped completely inside pipe 12, collet 82 engages collet latch 81. Sleeve 80 is now secured between wedge 34 and inner pipe 14, thus allowing pipe 12 to be pulled out from the well and inner pipe 14 removed.

Figure 3B:
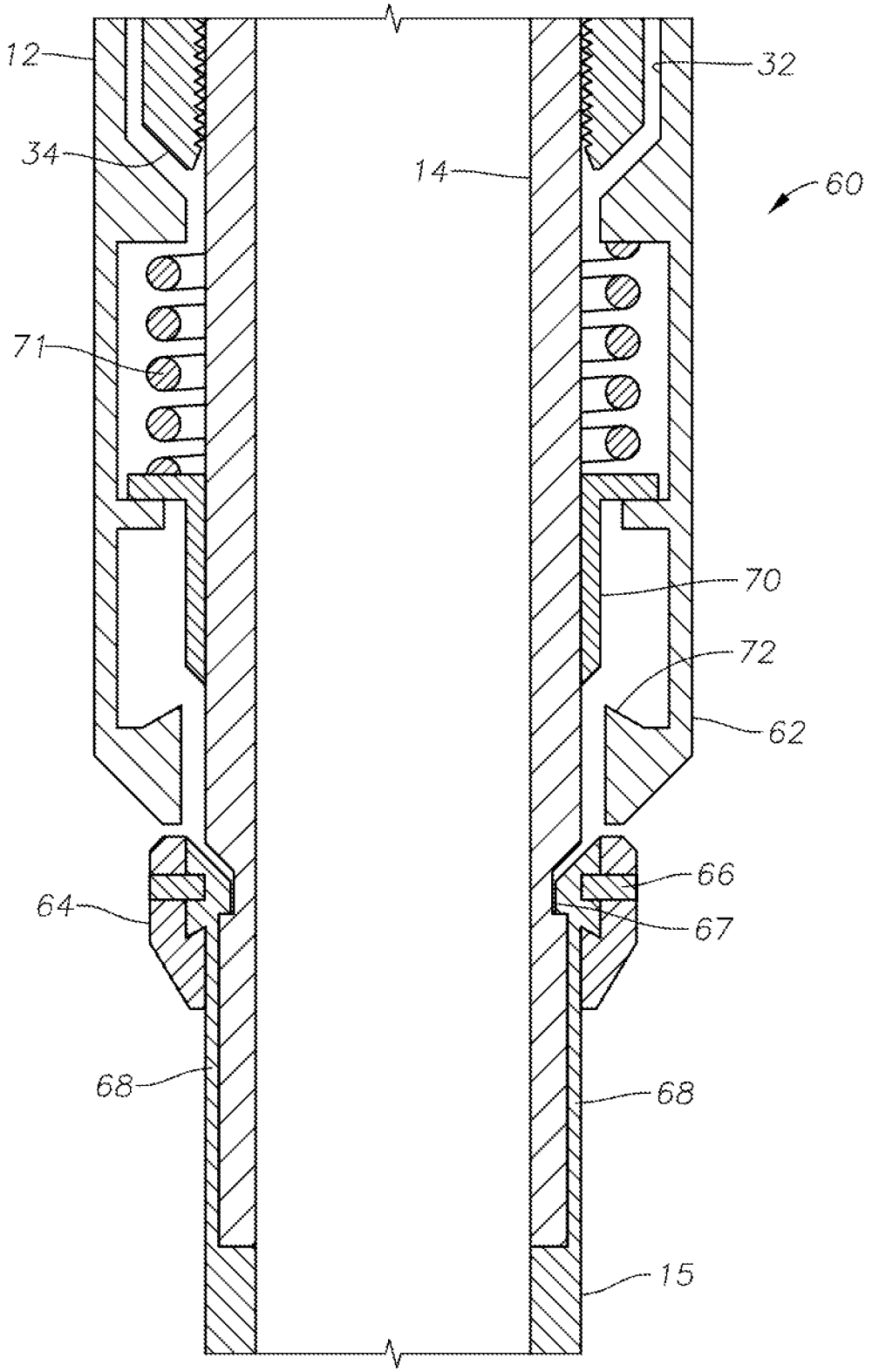

In yet another exemplary embodiment shown in FIG. 3B, a disconnect assembly 60 is positioned along pipe 12 below telescoping locking assembly 25. Disconnect assembly 60 comprises an upper latch 62, upper latch lock 70, and spring 71. Working in conjunction with disconnect assembly 60 are latching fingers 68 that extend from packer section 15. In this exemplary embodiment, latching fingers 68 are machined portions of packer section 15 that extend therefrom. Before disconnection, latching fingers 68 couple inner pipe 14 to packer section 15 through the use of latch lock ring 64 which retains latching fingers 68 in groove 67 of inner pipe 14.

At the completion of testing or stimulation, inner pipe 14 is almost fully retracted inside of pipe 12, as shown. Thereafter, pipe 12 is lowered into the well once again, and upper latch 62 will contact latch lock ring 64. Additional downward force will then result in shearing of shear ring 66. The will allow latch lock ring 64 to be pushed outwardly relative to latching fingers 68. Further downward movement of pipe 12 will allow latching fingers 68 to enter upper latch 62 of disconnect assembly 60, where upper latch lock 70, being biased downwardly by spring 71, will force latching fingers 68 outwardly. As a result, latching fingers 68 will become disconnected from inner pipe 14 and latch into profile 72, where spring 71 ensures upper latch lock 70 retains latching fingers 68 in profile 72. Thereafter, inner pipe 14 can now be pulled out of pipe 12, while packer section 15 remains downhole for further operations.

Exemplary embodiments of the present invention can be altered in a variety of ways. For example, if utilized for drill stem testing, a second seal (not shown) could be placed at the lower end of profiled area 32 to seal against inner pipe 14, thus preventing debris from entering the annulus between the pipe strings during stimulation operations. If such an embodiment were utilized, a check valve may be positioned along pipe 12 between the two seals (e.g., where port 24 is shown) which would allow fluid from outside pipe 12 to fill the annulus, while at the same time retaining pressures within the annulus during stimulation.

Furthermore, exemplary embodiments of the present invention may be designed for open or cased hole use. If open hole, an equalizing system may be required to maintain the pressure below the bottom packer the same as the pressure above the upper packer, as would be understood by those ordinarily skilled in the art having the benefit of this disclosure. In addition, if the stimulation pressures are very high, a packer locking mechanism may be utilized to retain the packers in the set position when injection pressure is higher than the pressure outside this region, as would also be understood by those same ordinarily skilled persons having the benefit of this disclosure. As such, the pressures will be restrained from unsetting the packers.

Accordingly, exemplary embodiments of the present invention allow the surface piping to be made up and tested once, while also allowing multiple isolations for testing and/or stimulation (e.g., testing, injection, fracturing, etc.) desired sections of a zone of interest. As such, it can be determined which areas of the well are providing production and pressure for drill stem testing analysis. In addition, when used for stimulation, the present invention provides assurances that all areas of the zone of interest receive stimulation fluid, not just those areas that accept the fluid the easiest.

An exemplary embodiment of the present invention provides a downhole isolation assembly, comprising an outer pipe string, an inner pipe positioned along an inner diameter of the outer pipe string, a telescoping assembly positioned along the outer pipe string to selectively telescope the inner pipe along the inner diameter of the outer pipe string, and a packer section extending below the inner pipe, the packer section comprising an upper packer, a zone port, and a lower packer positioned below the zone port. An alternate embodiment further comprises a flexible seal to seal between the outer pipe string and the inner pipe. In another, the telescoping assembly comprises a telescoping latch and a wedge, wherein the telescoping latch is adapted to selectively actuate to allow the wedge to wedge against the inner pipe.

In yet another embodiment, the packer section further comprises a ball and ball seat disposed at a lower end of the packer section. Another exemplary embodiment further comprises an assembly to disconnect the inner pipe from the outer pipe string. Yet another further comprises a slip assembly positioned along the packer section. Another embodiment further comprises a drag block assembly positioned along the packer section.

Another exemplary embodiment of the present invention provides a downhole isolation assembly, comprising a first tubular section with a first inner diameter, a second tubular section with a diameter smaller than the first inner diameter, an assembly to telescope the second tubular section within the inner diameter of the first tubular section and a packer section to isolate a section of interest along a zone of interest. In another, the packer section is positioned below the second tubular section. In yet another, the packer section further comprises an upper packer, a zone port and a lower packer positioned below the zone port.

In yet another exemplary embodiment, the assembly to telescope the second tubular section along the first inner diameter of the first tubular section comprises a latch and a wedge, wherein the latch is adapted to actuate to allow the wedge to wedge against the second tubular section. In another, the packer section further comprises a ball seat formed at a lower end of the packer section. Yet another further comprises an assembly to disconnect the second tubular section from the first tubular section.

An exemplary methodology of the present invention provides a method to isolate a section of a wellbore along a zone of interest, the method comprising positioning an isolation assembly adjacent the zone of interest, isolating a first section along the zone of interest, conducting a downhole operation along the first section, telescoping an inner pipe of the isolation assembly within an outer pipe of the isolation assembly, isolating a second section along the zone of interest and conducting a downhole operation along the second section. In another, conducting the downhole operation comprises conducting at least one of a testing or stimulation operation.

In yet another, isolating the first and second sections comprises activating a first packer above the sections and activating a second packer below the sections. In another methodology, telescoping the inner pipe within the outer pipe comprises actuating a telescoping assembly to release the inner pipe, allowing the inner pipe to telescope along the outer pipe and actuating the telescoping assembly to secure the inner pipe along the outer pipe. Another methodology further comprises disconnecting the inner pipe from the outer pipe.

Yet another exemplary embodiment of the present invention provides a downhole isolation method, comprising isolating two or more sections along a zone of interest and performing at least one of a testing or stimulation operation on each section, wherein the is method is conducted in a single downhole trip. In another, the method is performed without requiring disconnection of pressure lines.

The foregoing description and figures are not drawn to scale, but rather are illustrated to describe various embodiments of the present invention in simplistic form. Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. For example, those of ordinary skill in the art will appreciate that, while the micro zonal isolation system of the current invention is described as being deployed on a pipe string, in other embodiments, the system may instead be deployed on coiled tubing, wireline or slick line. Accordingly, the intention is to cover all modifications, equivalents and alternatives falling within the spirit and scope of the invention as defined by the appended claims.

What is claimed is:

1. A downhole isolation assembly, comprising:

an outer pipe string;

an inner pipe positioned along an inner diameter of the outer pipe string;

a telescoping assembly positioned along the outer pipe string to selectively telescope the inner pipe along the inner diameter of the outer pipe string, the telescoping assembly comprising:

a telescoping latch selectively movable among a weight-on position, a de-telescoping position and an in-tension position; and a wedge positioned along the inner pipe, the wedge operably coupled to the telescoping latch such that wedge grips the inner pipe to transfer weight on the outer pipe string to the inner pipe when the telescoping latch is in the weight-on position, such that the wedge releases the inner pipe to permit weight on the outer pipe string to slide the outer pipe string along the inner pipe when the telescoping latch is in the de-telescoping position, and such that the wedge grips the inner pipe to transfer tension to the inner pipe when the outer pipe is picked up and the telescoping latch is in the in-tension position; and a packer section extending below the inner pipe, the packer section comprising:

an upper packer;

a zone port; and a lower packer positioned below the zone port.

2. An assembly as defined in claim 1, further comprising a flexible seal to seal between the outer pipe string and the inner pipe.

3. An assembly as defined in claim 1, wherein the profiled area along the inner diameter of the outer pipe string comprises an angular surface which forces the wedge to grip the inner pipe in response to the selective contact of the telescoping latch.

4. An assembly as defined in claim 1, wherein the packer section further comprises a ball and ball seat disposed at a lower end of the packer section.

5. An assembly as defined in claim 1, further comprising an assembly to disconnect the inner pipe from the outer pipe string, the assembly comprising:

a sleeve positioned around the inner pipe, the sleeve having a collet attached thereto; and a collet latch positioned along the inner diameter of the outer pipe string, the collet latch being adapted to engage the collet to thereby secure the sleeve between the wedge and the inner pipe.

6. An assembly as defined in claim 1, further comprising an assembly to disconnect the inner pipe from the outer pipe string, the assembly comprising:

a latching finger positioned around the inner pipe;

a latch lock positioned around the inner pipe above the latching finger, the latch lock being operably connected to the outer pipe string; and a latch profile positioned along the inner diameter of the outer pipe string, wherein the latch lock selectively forces the latching finger into the latch profile to thereby secure the latching finger to the outer pipe string.

7. An assembly as defined in claim 1, further comprising a drag block assembly positioned along the packer section.

8. A downhole isolation assembly, comprising:

a first tubular section with a first inner diameter;

a second tubular section with a diameter smaller than the first inner diameter;

an assembly to telescope the second tubular section within the inner diameter of the first tubular section, the assembly comprising:

a latch selectively movable among a weight-on position, a de-telescoping position and an in-tension position; and a wedge, wherein the latch telescopes among the weight-on position, the de-telescoping position and the in-tension position to allow the wedge to selectively wedge against the second tubular section in response to movement of the first tubular section along the second tubular section; and a packer section to isolate a section of interest along a zone of interest.

9. An assembly as defined in claim 8, wherein the packer section is positioned below the second tubular section.

10. An assembly as defined in claim 9, wherein the packer section further comprises:

an upper packer;

a zone port; and a lower packer positioned below the zone port.

11. An assembly as defined in claim 8, wherein the packer section further comprises a ball seat formed at a lower end of the packer section.

12. An assembly as defined in claim 8, further comprising an assembly to disconnect the second tubular section from the first tubular section.

13. A method to isolate a section of a wellbore along a zone of interest, the method comprising:

positioning an isolation assembly adjacent the zone of interest;

isolating a first section along the zone of interest;

conducting a downhole operation along the first section;

telescoping an inner pipe of the isolation assembly within an outer pipe of the isolation assembly;

isolating a second section along the zone of interest; and conducting a downhole operation along the second section, wherein telescoping the inner pipe within the outer pipe comprises actuating a telescopic latch of a telescoping assembly among a weight-on position, a de-telescoping position and an in-tension position to cause a wedge of the telescoping assembly to both grip the inner pipe when the telescopic latch is in the weight-on and in tension positions, and to release the inner pipe when the telescopic latch is in the de-telescoping position by placing weight down on the isolation assembly.

14. A method as defined in claim 13, wherein conducting the downhole operation comprises conducting at least one of a testing or stimulation operation.

15. A method as defined in claim 13, wherein isolating the first and second sections comprises:

activating a first packer above the sections; and activating a second packer below the sections.

16. A method as defined in claim 13, wherein telescoping the inner pipe within the outer pipe comprises:

actuating a telescoping assembly to release the inner pipe;

allowing the inner pipe to telescope along the outer pipe; and actuating the telescoping assembly to secure the inner pipe along the outer pipe.

17. A method as defined in claim 13, further comprising disconnecting the inner pipe from the outer pipe.

18. An assembly as defined in claim 8, wherein the wedge wedges against the second tubular every other time the first tubular section moves down relative to second tubular section.

* * * * *